US008376102B2

(12) United States Patent
Ritschel

(10) Patent No.: US 8,376,102 B2
(45) Date of Patent: Feb. 19, 2013

(54) GARMENT ORGANIZING ASSEMBLY AND METHOD

(76) Inventor: Kim Ritschel, Barrington, IL (US)

( * ) Notice: Subject to any disclaimer, the term of this patent is extended or adjusted under 35 U.S.C. 154(b) by 533 days.

(21) Appl. No.: 12/587,815

(22) Filed: Oct. 14, 2009

(65) Prior Publication Data

US 2011/0083931 A1 Apr. 14, 2011

(51) Int. Cl.
*B65D 30/22* (2006.01)

(52) U.S. Cl. ..... 190/108; 190/13 C; 190/36; 190/110; 150/127; 150/128; 150/130; 206/292; 206/287; 206/278

(58) Field of Classification Search ..... 190/13 C, 190/36, 108, 110; 150/146, 127, 113, 128, 150/130; 206/290, 292, 293, 297, 299, 278
See application file for complete search history.

(56) References Cited

U.S. PATENT DOCUMENTS

| | | | | | |
|---|---|---|---|---|---|
| 287,680 | A | * | 10/1883 | Jenks | 150/110 |
| 2,176,792 | A | | 10/1939 | Currie | |
| 2,502,033 | A | | 3/1950 | Bohn | |
| 2,521,100 | A | * | 9/1950 | Sublette | 223/69 |
| 2,536,169 | A | * | 1/1951 | Gray | 190/103 |
| 2,856,110 | A | * | 10/1958 | Cowan | 223/89 |
| 4,067,066 | A | | 1/1978 | Bruno | |
| 4,562,952 | A | | 1/1986 | Chinman | |
| 4,593,812 | A | * | 6/1986 | Dillingham | 206/292 |
| 4,773,515 | A | * | 9/1988 | Kotkins, Jr. | 190/103 |
| 4,825,985 | A | | 5/1989 | Kim | |
| 4,854,431 | A | | 8/1989 | Pulichino, Jr. | |
| 4,995,436 | A | * | 2/1991 | Cantor | 150/102 |
| RE33,794 | E | | 1/1992 | King et al. | |
| 5,255,766 | A | | 10/1993 | Deconninck | |
| 5,501,324 | A | | 3/1996 | Franklin et al. | |
| 5,505,297 | A | | 4/1996 | Myers | |
| 5,566,797 | A | | 10/1996 | Van Himbeeck | |
| 5,575,391 | A | | 11/1996 | Gerch | |
| 5,622,255 | A | | 4/1997 | Riccoboni | |
| 5,624,026 | A | | 4/1997 | Chernoff | |
| 5,651,455 | A | * | 7/1997 | Garcia | 206/287.1 |
| 5,983,969 | A | * | 11/1999 | Morgan | 150/104 |
| 6,257,381 | B1 | * | 7/2001 | Harfst | 190/108 |
| 6,293,443 | B1 | | 9/2001 | Nykoluk | |
| 6,394,497 | B1 | * | 5/2002 | Ho | 281/29 |
| 6,457,635 | B1 | * | 10/2002 | Scicluna | 229/87.17 |
| 6,739,754 | B2 | * | 5/2004 | Moor et al. | 383/40 |
| 7,140,479 | B2 | | 11/2006 | Mangano et al. | |
| 7,207,426 | B2 | | 4/2007 | Godshaw et al. | |
| 7,814,948 | B2 | * | 10/2010 | Amante | 150/106 |
| 7,886,949 | B2 | * | 2/2011 | Fenton et al. | 224/652 |
| 8,087,555 | B2 | * | 1/2012 | Criscuolo | 223/85 |
| 2003/0221978 | A1 | * | 12/2003 | Redzisz | 206/278 |
| 2004/0253046 | A1 | * | 12/2004 | Africa et al. | 402/73 |

(Continued)

*Primary Examiner* — Tri Mai
(74) *Attorney, Agent, or Firm* — Meroni & Meroni, P.C.; Charles F. Meroni, Jr.; Christopher J. Scott

(57) ABSTRACT

A garment organizing system, assembly, and method enables users to organize garmentry for travel. The basic assembly comprises a support panel, a restraint panel, a panel attachment mechanism for removably attaching each restraint panel to a first edge of a respective support panel, and a panel linking mechanism for linking each support panel to an adjacent support panel. The support panels support garmentry placed thereupon. Each restraint panel is fixedly attached to a second edge of a respective support panel, and the restraint panels selectively restrain garmentry supported by the support panels via said panel attachment mechanism. The panel linking mechanism enables the user to link and stack a series of interconnectable garment restraint assemblies for organizing the supported and restrained garmentry for travel.

4 Claims, 14 Drawing Sheets

U.S. PATENT DOCUMENTS

2005/0232519 A1* 10/2005 Grimes, Jr. ..... 383/39
2006/0086628 A1 4/2006 Deutschendor et al.
2007/0044877 A1* 3/2007 Davidoff et al. ..... 150/113
2007/0181626 A1* 8/2007 Fenton et al. ..... 224/652

* cited by examiner

FIG. 9
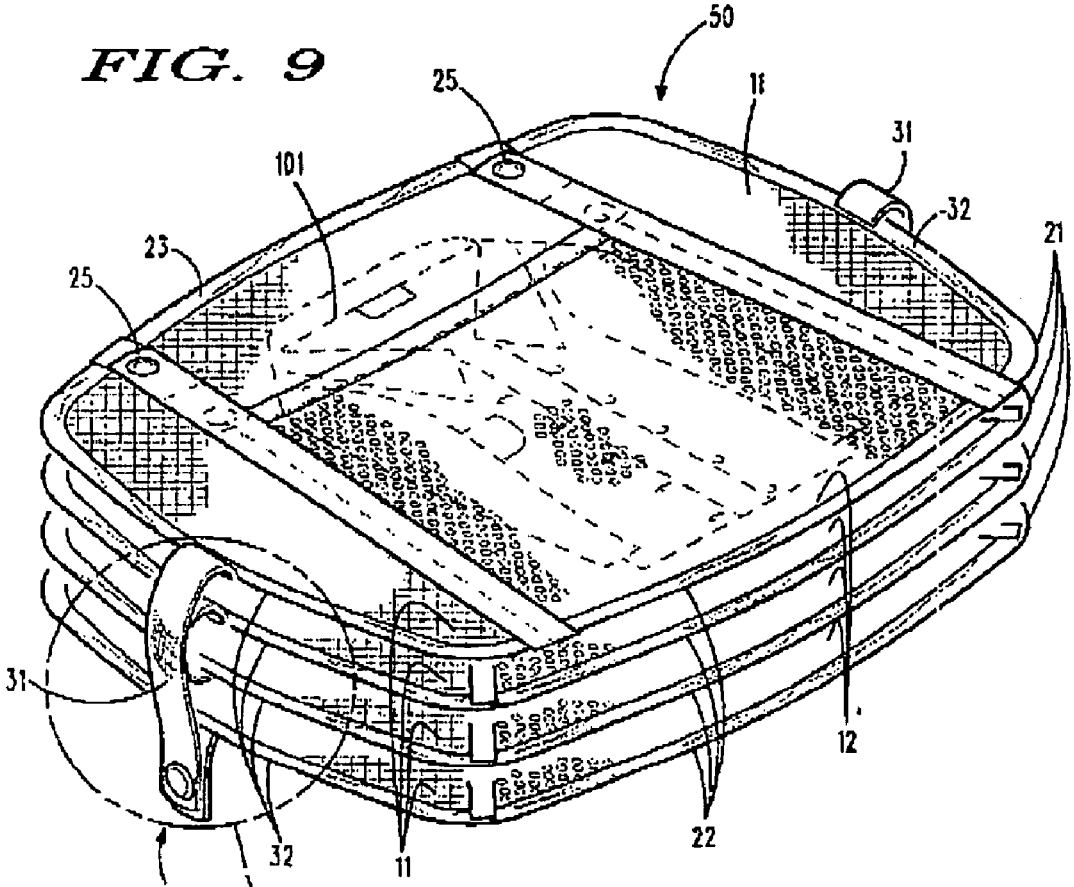
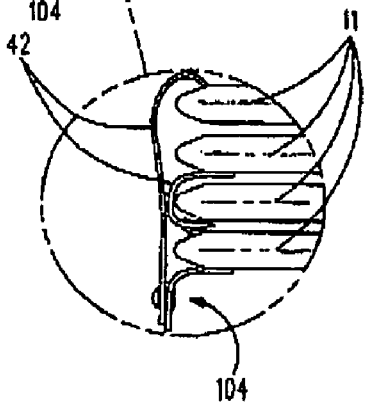
FIG. 9a

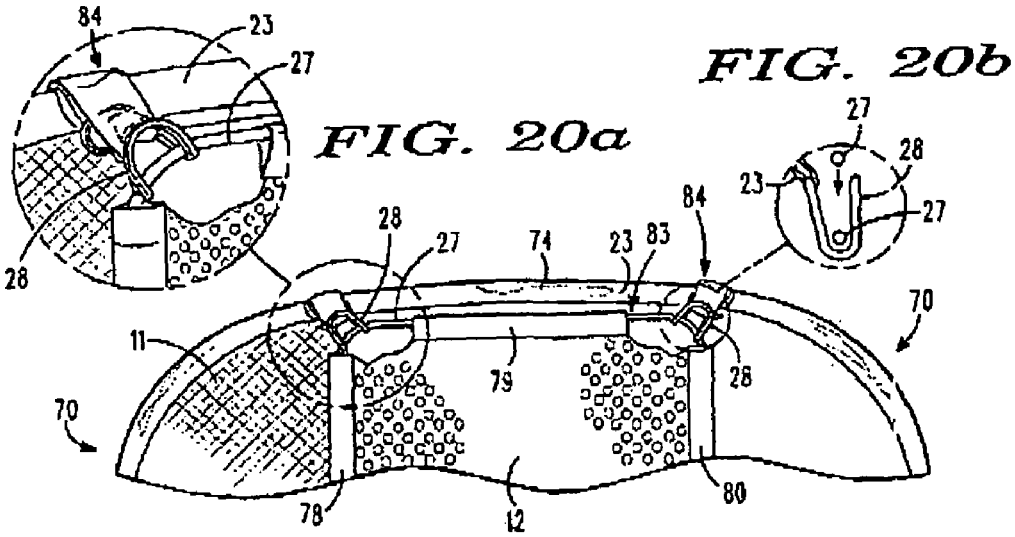
FIG. 20a
FIG. 20b
FIG. 20
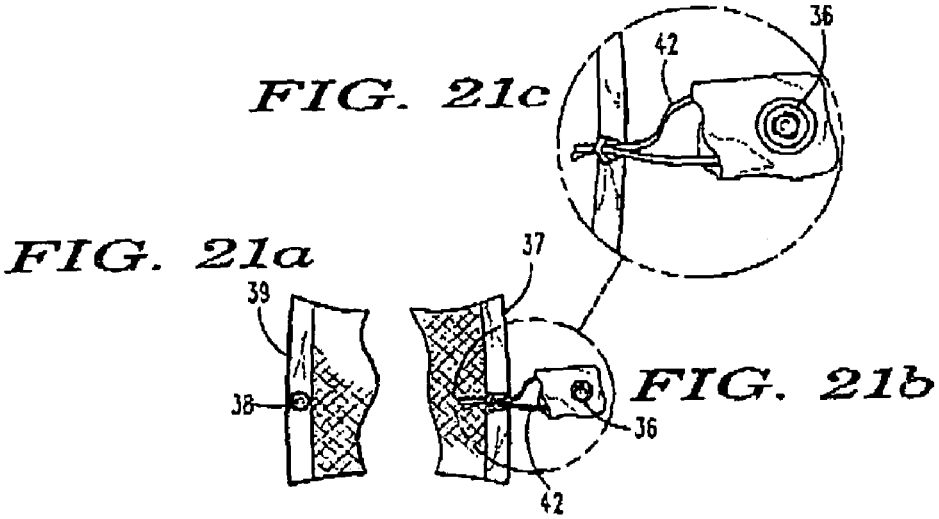
FIG. 21c
FIG. 21a
FIG. 21b
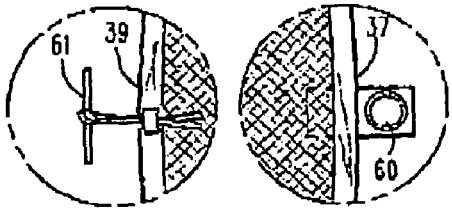
FIG. 22a
FIG. 22b

GARMENT ORGANIZING ASSEMBLY AND METHOD

BACKGROUND OF THE INVENTION

1. Field of the Invention

The present invention generally relates to an assembly for restraining garmentry and similar other travel items during travel. More particularly, the present invention relates to an assembly or series of interconnectable assemblies for organizing garmentry during travel, which garment organizing assembly and/or system supports and restrains garmentry intermediate opposing panels.

2. Description of Prior Art

The prior art is replete with examples of garmentry-receiving and/or garmentry-organizing luggage and the like. Separate systems and/or assemblies for organizing garmentry, which separate systems and/or assemblies may be used in conjunction with standardized luggage, are less well known. Some of the more pertinent prior art relating to luggage-organizing assemblies and the like usable in combination with standardized luggage are described hereinafter.

U.S. Pat. No. 4,562,952 ('952 patent), which issued to Chinman, discloses a Wrapper for Clothing. The '952 patent describes a wrapper for clothing and the like comprising a flexible member having a central area with a plurality of outwardly extending wing sections. A reinforcing base is provided in the central area. The wrapper also includes a shape retainer having the same geometric shape as the reinforcing member but being of a lesser dimension. Accordingly, articles of clothing may be folded around the shape retainer so that the articles are folded into the geometric shape, and the articles may then be placed on top of the base. The wing sections may then be folded over the articles to wrap the articles therein.

U.S. Pat. No. 4,854,431 ('431 patent), which issued to Pulichino, Jr. et al., discloses a Suitcase with Compartment for a Foldable Garment Bag. The '431 patent describes a suitcase comprising a generally rectangular container, a partition dividing said container into two compartments, a full length garment bag having at least one clothes hanger, said garment bag consisting of an elongated fabric sheath for enclosing a suit or dress and including means for opening said bag while it is unfolded with a garment hanging freely in it and thereafter closing said bag upon a garment, said garment bag being folded upon itself in one of said compartments.

U.S. Pat. No. 5,501,324 ('324 patent), which issued to Franklin et al., discloses a Soft-Sided Luggage Case with Interfitting and Foldably Separate Packing Compartments. The '324 patent describes an openable and closeable soft-sided luggage case having an external flexible panel, an internal frame structure surrounding an internal cavity, and a carrying handle or a carrying strap connected to the frame structure, includes a first packing compartment which is connected to the external panel. The first packing compartment extends into the interior cavity and consumes a portion of the interior cavity when the case is closed.

The remaining portion of the interior cavity forms a second packing compartment. The first packing compartment includes a cover member which is selectively closeable for separating the first and second packing compartments when the case is closed and which is selectively openable for allowing access to the first packing compartment when the case is opened. The first and second packing compartments are equally accessible and available for packing. The first packing compartment may function as a garment bag. A packing and unpacking method is also used for the case.

U.S. Pat. No. 5,505,297 ('297 patent), which issued to Myers, discloses a Garment Bag Construction to Minimize Wrinkling. The '297 patent describes a garment bag of the type having an elongate body substantially formed of flexible fabric or sheet material, and defining a cavity with a hanger support at the top for receiving hanging clothes on hangers. The bag folds double on itself for transport, and includes a pair of rigid wall portions which when the bag is folded double on itself are urged forcefully together.

These rigid wall portions substantially immobilize the clothing items therebetween to greatly reduce creasing and wrinkling of the clothing items which would otherwise result from their shifting about in transit. The garment bag also includes features preserving the efforts of careful packing during folding and unfolding of the bag to further reduce clothes wrinkling. Also, the garment bag includes a specially configured toiletries kit which by its shape and placement in the folded bag further contributes to a reduction of clothes wrinkling. The garment bag is also self-supporting in its transport conditions so that it is more convenient to carry by hand.

U.S. Pat. No. 5,255,766 ('766 patent), which issued to Deconinck, discloses a Travelling or Packing Bag. The '766 patent describes a bag enabling personal belongings to be packed and carried inside a case comprises a rigid inner tray having a support edge of rounded profile and a packing wall which is at least partly solid. The tray is pivotable between a horizontal position and a vertical position. Personal belongings can be laid flat on the packing wall when the tray is in the horizontal position. In the vertical position a jacket previously folded in two in the longitudinal direction and a pair of trousers can be laid astride the edge.

U.S. Pat. No. 5,624,026 ('026 patent), which issued to Chernoff, discloses a Garment Holding Device for use with Various Types of Luggage. The '026 patent describes a novel garment holding device for use with various types of luggage comprising a substantially cylindrical hollow tube about which suits and other garments can be completely wrapped, a fabric cover for holding garments securely about the outside surface of the tube, and a flexible hanger which is capable of holding suits and other garments against the outside of the tube while being flexible enough to conform to the curvature of the tube.

A fabric cover wraps around the garments and the tube and holds the garments securely against the outer surface of the tube. Because the garments will be rolled instead of folded, wrinkling of the garments will be reduced. The hollow center of the cylinder is utilized to carry bulky and awkward shaped objects such as shoes and shaving or makeup kits. The tube, when holding a garment wrapped around its outer surface, can be carried inside any luggage of appropriate size. Because of the novel way the suits and garments are wrapped around the outside of a cylinder the overall shape of the luggage can be more compact and easier to carry.

U.S. Pat. No. 5,575,391 ('391 patent), which issued to Gerch, discloses a Garment Carrier within Suitcase and Method for Packing. The '391 patent describes a luggage piece and a method for packing and transporting the same. A first compartment has an interior for carrying first items. A second compartment is provided for carrying second items. The second items are distinguishable from the first items in that the second compartment includes a hanging device for hanging articles from the hanging device.

The second compartment, therefore, acts as a garment carrier and the first compartment acts as a standard luggage compartment. The first compartment and the second compartment are integrally formed as a single luggage piece for simple packing and unpacking of articles as well as simplified transport of the luggage piece following packing of the articles. An extendable arm having a handle and wheels is provided for transport of the luggage piece.

U.S. Pat. No. 7,207,426 ('426 patent), which issued to Godshaw et al., discloses a Combination Duffle and Garment Bag. The '426 patent describes a luggage item convertible from a duffle bag form to a garment bag form by disengaging duffle end panels from the lateral sides of the garment bag and folding those end panels against the inside of the garment bag. Various arrangements of handles and carry straps are disclosed which facilitate transport of the luggage item as a duffle bag or a garment bag.

It may be seen from a review of the prior art that the prior art fails to disclose a garment organizing system, assembly, and method whereby one or more support panels support garmentry placed thereupon, and one or more restraint panels are fixedly attached to respective support panels for selectively restraining panel-supported garmentry. A plurality of support panels may then be linked together and stacked into columns, and the columnar stacks may then be neatly inserted into standardized luggage for further travel. The prior art thus perceives a need for such a garment organizing system, assembly, and method as described in more detail hereinafter.

SUMMARY OF THE INVENTION

The present invention essentially provides a garment organizing system for use with travel, which garment organizing system comprises a series of linkable or interconnectable garment restraint assemblies. Each garment restraint assembly comprises a support panel; a restraint panel fixedly attached to a first edge of the support panel; certain attachment means for removably attaching the restraint panel to a second edge of the support panel; and certain panel linking means for linking or interconnecting each support panel to an adjacent support panel.

It is contemplated that said panel attachment means may be defined by any number of attachment devices or attachment mechanisms, and it is contemplated that said panel linking means may be defined by any number of linking devices or linking mechanisms. The linking devices or mechanism allow or enable the user to link the support panels to one another such that the support panels may rotate, fold, or twist at the panel junction site to allow the support panels to be stacked into columns such that the restraint panels and support panels are arranged in an alternating manner from the bottom to the top of the panel stack. The stacked column of garment restraint assemblies may then be placed into luggage for further travel purposes.

BRIEF DESCRIPTION OF THE DRAWINGS

Other features of my invention will become more evident from a consideration of the following brief description of patent drawings:

FIG. 1(*a*) is an enlarged, fragmentary sectional view of a portion of a support panel with parts broken away to show structure for maintaining the form and function of the support panel periphery.

FIG. 3(*a*) is an enlarged, fragmentary side view of the junction site between adjacent support panels otherwise depicted in FIG. 3 showing a first alternative panel linking mechanism, namely, a snap fastener assembly.

FIG. 3(*b*) is an enlarged, fragmentary side view of the junction site between adjacent support panels showing a second alternative panel linking mechanism, namely, a hook and loop type fastener arrangement.

FIG. 9 is a top perspective view of a series of interconnected garment restraint assemblies stacked into a garment restraint assembly column wherein the restraint panels are facing or pointing in a uniform direction.

FIG. 9(*a*) is an enlarged fragmentary side view depiction of a first edge of the garment restraint assembly column otherwise depicted in FIG. 9 showing a fastening mechanism fastening the top support panel to the bottom support panel of the stack.

FIG. 14(*a*) is an enlarged, fragmentary sectional view as sectioned from FIG. 14 showing the details of a third type of panel linking mechanism linking the two third alternative embodiments of the garment restraint assemblies, which panel linking mechanism is a looped cord-like structure.

FIG. 14(*b*) is an enlarged, fragmentary sectional view as sectioned from FIG. 14 showing the details of a cord length adjustment mechanism made a part of the restraint panel.

FIG. 15(*a*) is an enlarged view of a snap fastener arrangement axially displaceable along a length of fragmentary elastic cord.

FIG. 15(*b*) is an enlarged view of a loop assembly axially displaceable along a length of fragmentary elastic cord.

FIG. 16(*a*) is an enlarged side view of a flanged button attached to an edge of the support panel with a cord being removably received intermediate the edge of the support panel and the flanged portion of the button.

FIG. 20 is a fragmentary plan type depiction of an edge of a fourth alternative, embodiment of the garment restraint assembly showing the support panel outfitted with hooks and the restraint panel having exposed elastic cord portions receivable by the hooks for removably attaching the restraint panel to the support panel.

FIG. 20(*a*) is an enlarged fragmentary view showing details of the hooked junction site otherwise depicted in FIG. 20.

FIG. 20(*b*) is an enlarged fragmentary side view of the support panel of the fourth alternative embodiment of the garment restraint assembly showing a cord being received by a hook.

FIG. 21(*a*) is a fragmentary view of a first lateral back edge of a fourth alternative embodiment of the garment restraint assembly showing a male snap fastener structure attached thereto.

FIG. 21(*b*) is a fragmentary view of a second lateral front edge of a fourth alternative embodiment of the garment restraint assembly showing an extended female snap fastener structure attached thereto.

FIG. 21(*c*) is an enlarged depiction of the extended female snap fastener structure otherwise depicted in FIG. 21(*b*).

FIG. 22(*a*) is a fragmentary view of a first lateral edge of a fifth alternative, preferred embodiment of the garment restraint assembly showing a length of rigid material attached to the first lateral edge with a cord.

FIG. 22(*b*) is a fragmentary view of a second lateral edge of a fifth alternative, preferred embodiment of the garment restraint assembly showing an extended grommet assembly attached thereto.

DESCRIPTION OF THE PREFERRED EMBODIMENT(s)

Figures 1, 1A:
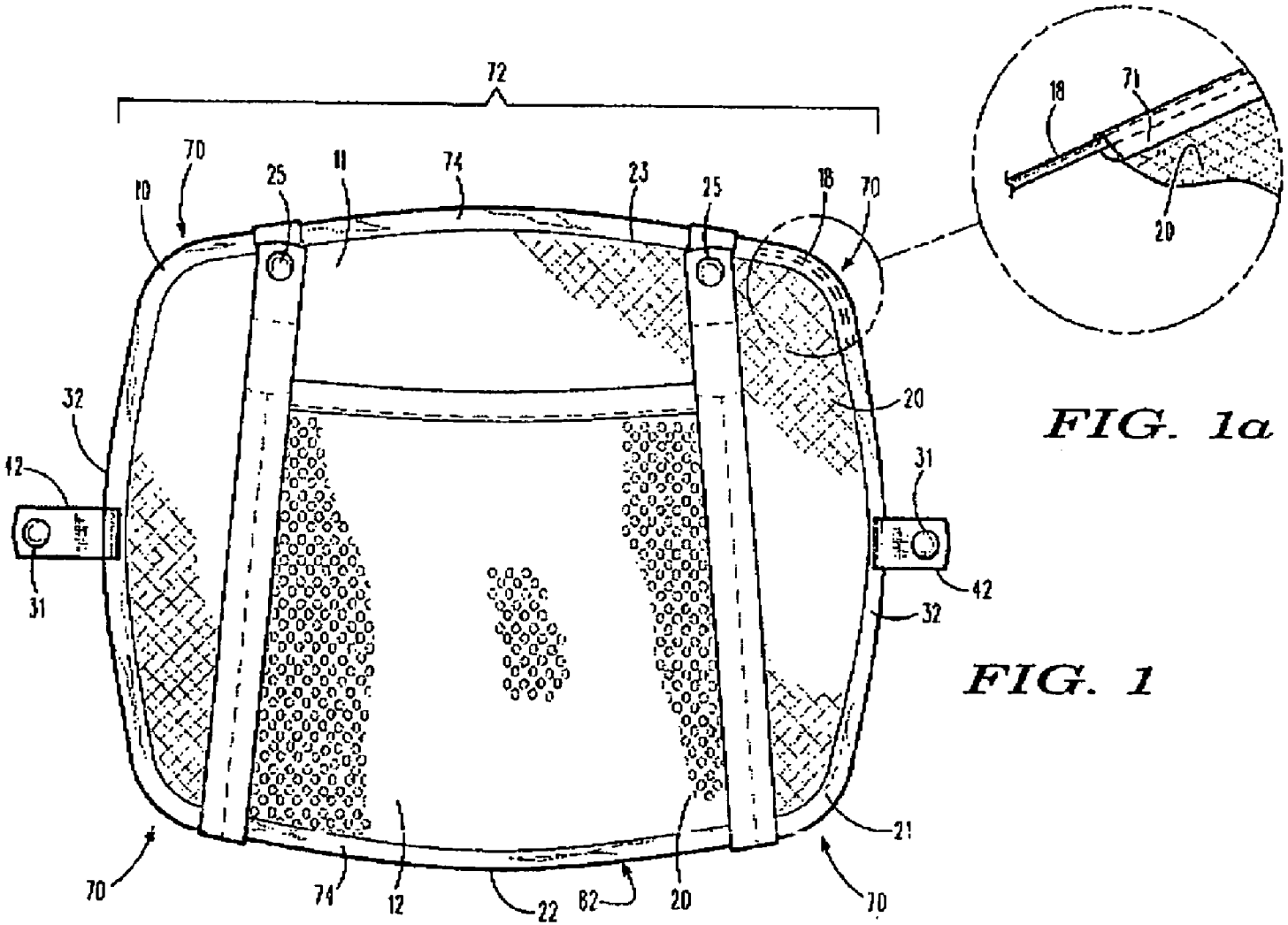
FIG. 1 is a top plan view of a first alternative embodiment of a garment restraint assembly according to the present invention.

Referring now to the drawings with more specificity, the preferred embodiment of the present invention essentially provides a garment organizing assembly and/or system for use with travel, which garment organizing system comprises a series of linkable or interconnectable garment restraint assemblies 10. Each garment restraint assembly 10 comprises a support panel 11; a restraint panel 12; certain panel attachment means for removably attaching each restraint panel to a respective support panel; and certain panel linking means for linking or interconnecting each support panel 11 to an adjacent support panel 11.

The support panels 11 function to support garmentry 101 placed thereupon as generally depicted in FIGS. 4, 5, 8, and 9. The support panels 11 are preferably constructed from flexible material such as fabric or netting 20, and preferably comprise certain peripheral support means for maintaining a substantially planar support panel periphery as at 21 about the garmentry supportive fabric, netting 20, or similar other garment supportive material.

Figure 10:
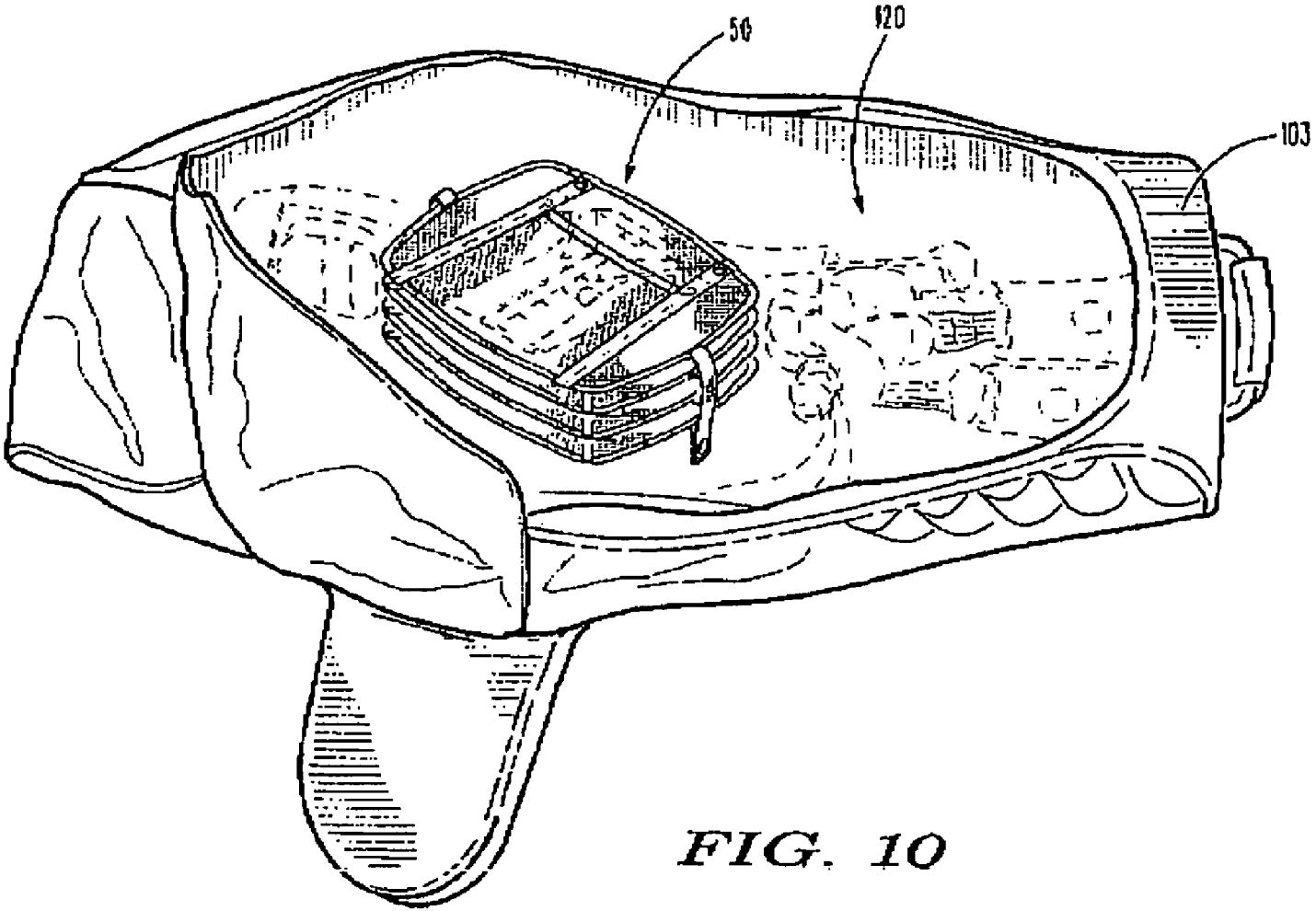
FIG. 10 is a depiction of a garment restraint assembly column received within luggage designed for receiving and transporting a golf bag for travel.
Figure 11:
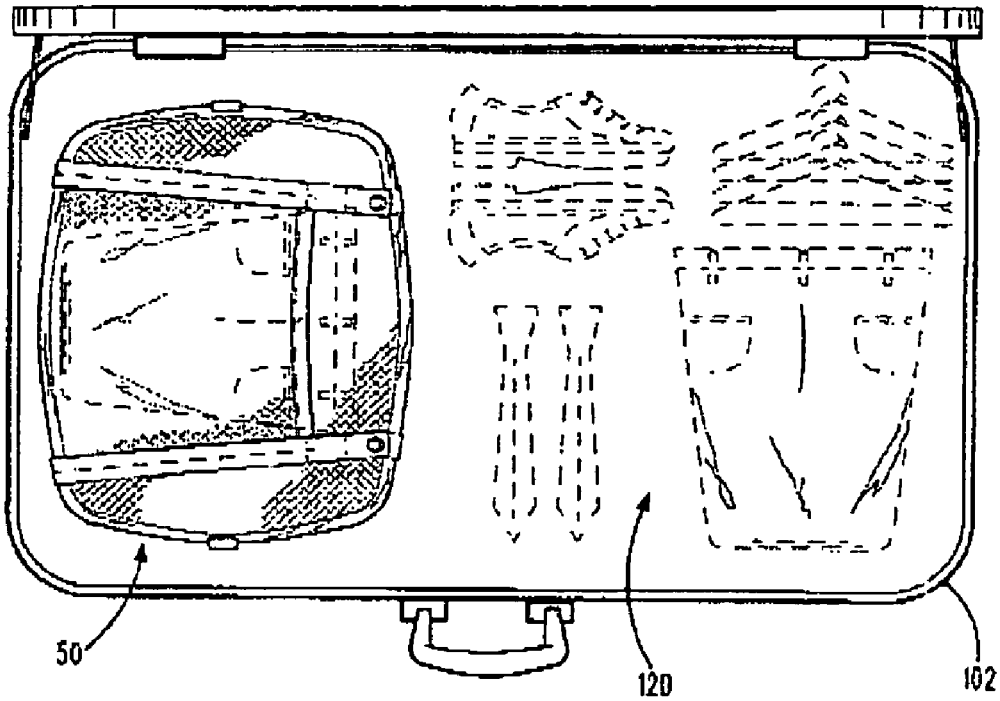
FIG. 11 is a top plan view of a standard suitcase with its lid open receiving various pieces of travel items (shown in broken lines) including a garment restraint assembly column.
Figure 12:
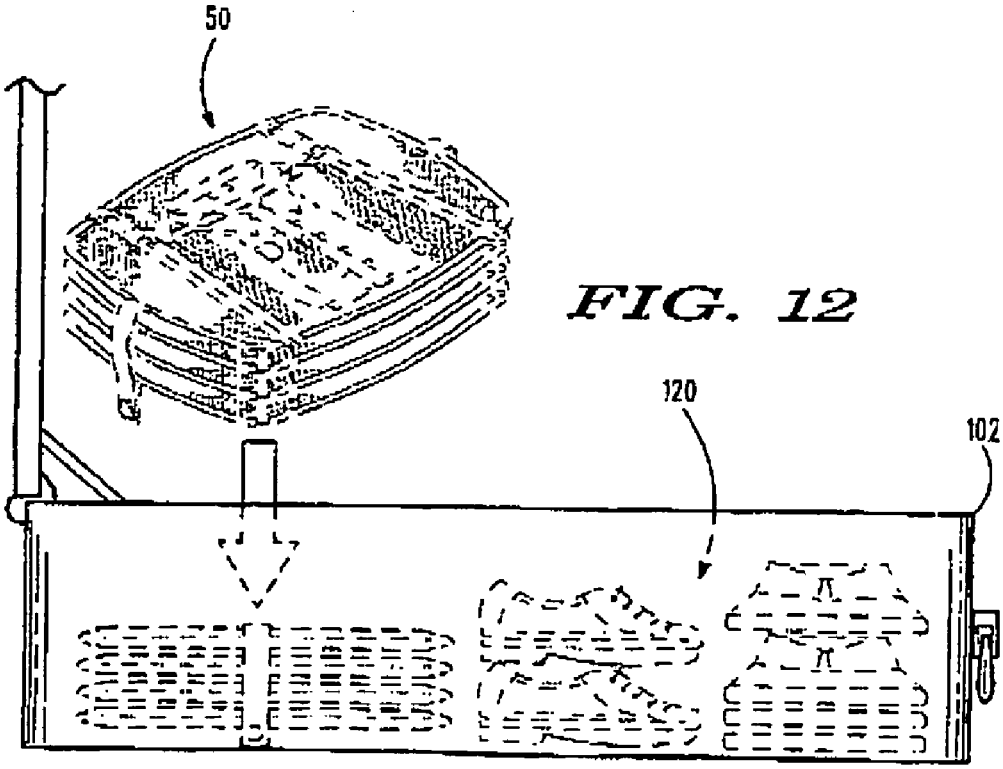
FIG. 12 is a side view depiction of a standard suitcase with its lid open receiving various pieces of travel items (shown in broken lines) including a garment restraint assembly column in the process of being inserted into the suitcase.

With regard to the peripheral support means, it is contemplated that the same may be defined by a form or frame-providing structure such as heavy gauge wire 18 or similar other structure, to which the fabric, netting 20 or similar other structure is permanently attached. The support panel peripheries 21 of support panels 11 are preferably sized and shaped for cooperable use with standardized luggage 102 as generally depicted in FIGS. 11 and 12. Luggage 103 for receiving and transporting a golf bag is further shown in FIG. 10 into which the stacked assemblies 10 or garment restraint assembly stacked column 50 may be placed.

The garment organizing system is thus contemplated to further comprise, in combination, an article of luggage (as at 102 and 103) as generally and generically depicted where the luggage has an interior as at 110 capable of receiving a garment restraint assembly column 50. It will thus be seen from an inspection of FIGS. 10-12 that the stackable garment restraint assemblies 10 or garment restraint assembly column 50 may thus be received in the spacious interior 110.

Each restraint panel 12 is preferably also constructed from flexible material such as fabric or netting 20, and is preferably and fixedly attached to a first edge 22 of a respective support panel 11 (as for example by way of stitching). Each restraint panel 12 is selectively and removably attachable to a second edge 23 of its respective support panel 11 via certain panel attachment means. It is contemplated that said panel attachment means may be defined by any number of attachment type devices or mechanisms. In this last regard, several examples of attachment type mechanisms have been depicted in the various figures.

Figure 2:
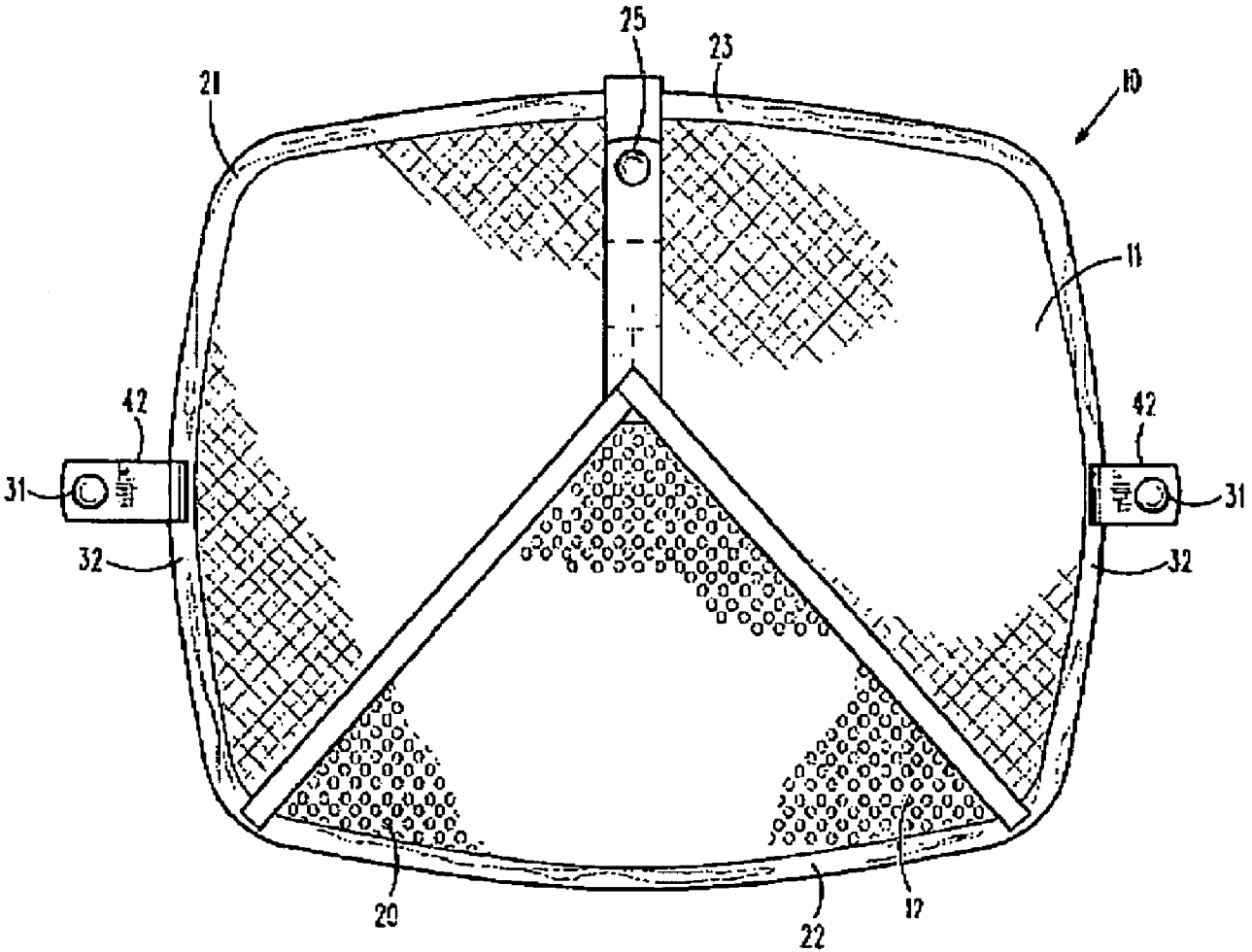
FIG. 2 is a top plan view of a second alternative embodiment of a garment restraint assembly according to the present invention.
Figures 3, 3A, 3B:
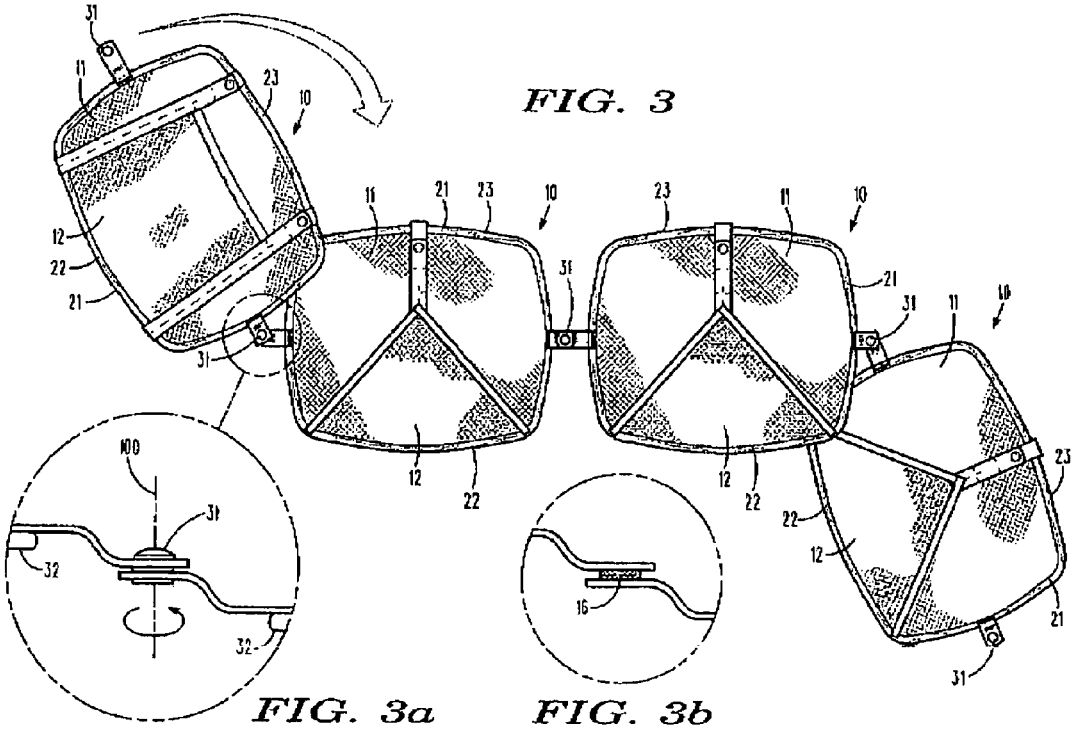
FIG. 3 is a top plan view of a series of interconnected garment restraint assemblies showing the first alternative embodiment of the garment restraint assembly (otherwise depicted in FIG. 1) connected to a series of three second alternative embodiments of the garment restraint assembly (otherwise depicted in FIG. 2).
Figure 4:
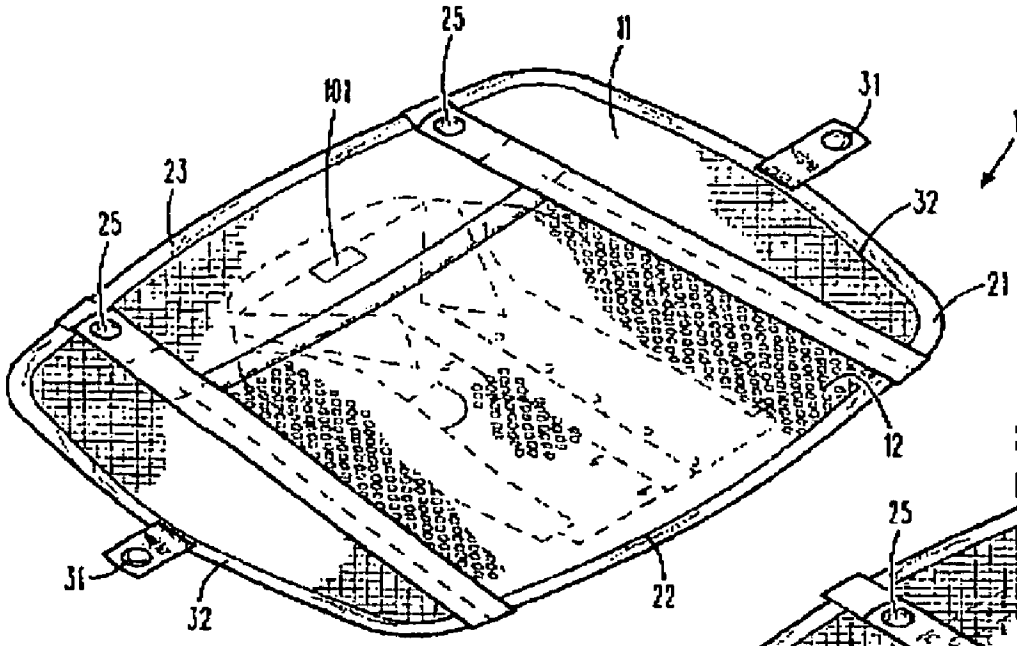
FIG. 4 is a top perspective view of the first alternative embodiment of the garment restraint assembly showing garmentry in broken lines as received and restrained intermediate the restraint panel and support panel.
Figure 5:
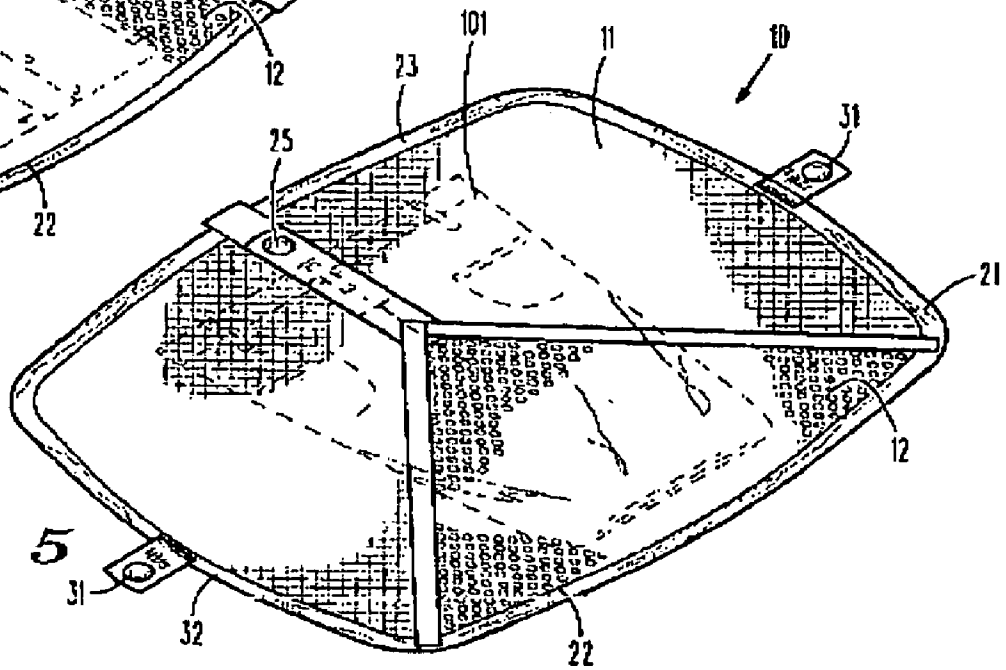
FIG. 5 is a top perspective view of the second alternative embodiment of the garment restraint assembly showing garmentry in broken lines as received and restrained intermediate the restraint panel and support panel.

FIGS. 1, 2, 3(*a*), 4, 5, and 9, for example, show or attempt to depict a first alternative type of attachment mechanism, namely, snap type fasteners 25. FIGS. 13, 14, 16, and 18 show or attempt to depict a second type of mechanism, namely, raised (flange-headed) buttons 26 over which exposed elastic cord 27 is looped such that the raised flange-headed buttons 26 receive the cord underneath the flanged-heads 40 and thus retain the cord 27. FIGS. 20-20(*b*) show saddle-shaped hooks 28 for receiving exposed portions of elastic cord 27. It is contemplated that saddle-shaped hooks 28 are the preferred means for selectively and removably attaching each restraint panel 12, to the second edge 23 of its respective support panel 11.

Figure 13:
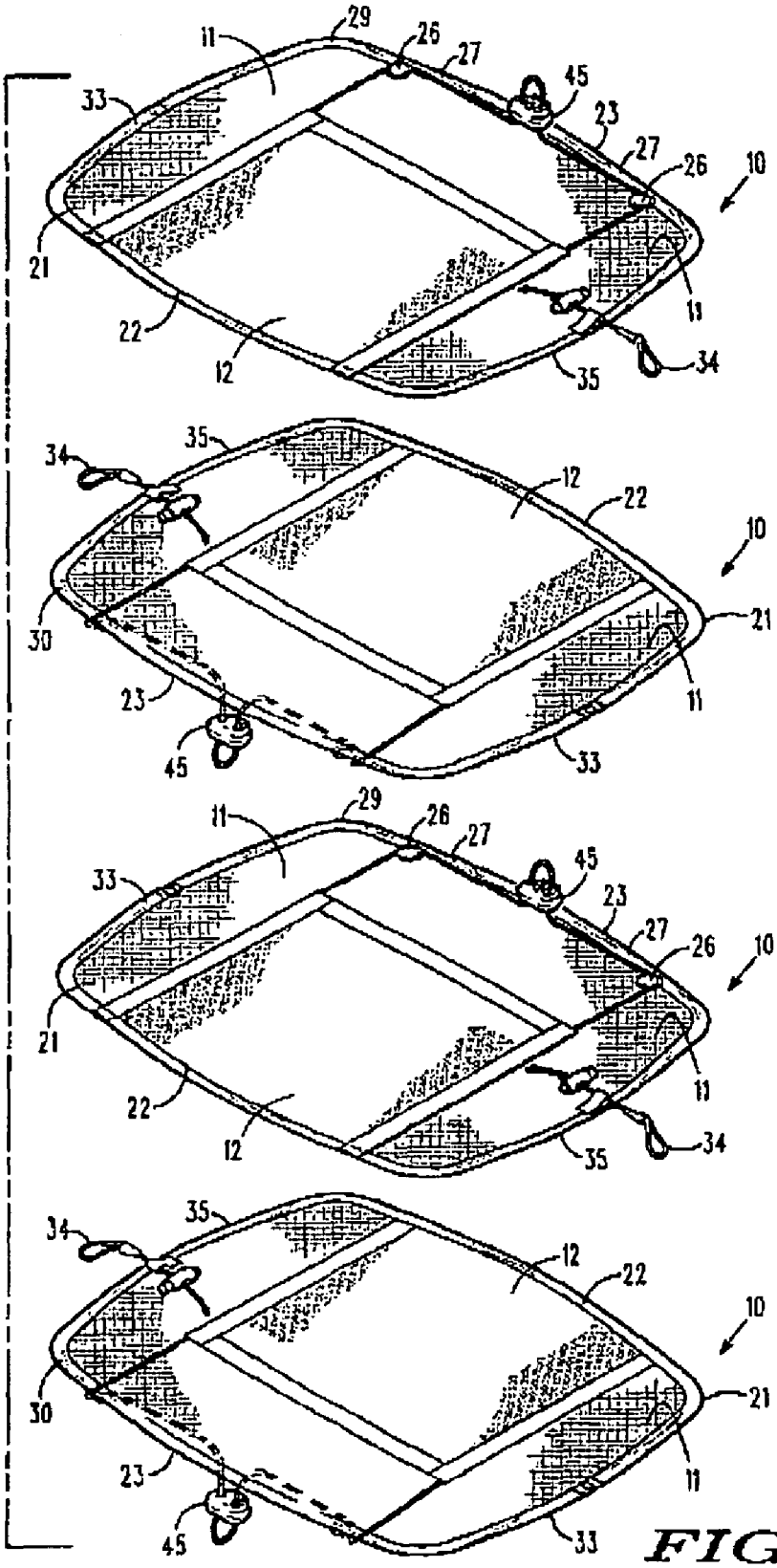
FIG. 13 is a top exploded type perspective view of a series of third alternative embodiments of the garment restraint assemblies showing the restraint panels of successfully stacked assemblies facing opposing directions.
Figures 14, 14A, 14B, 15A, 15B:
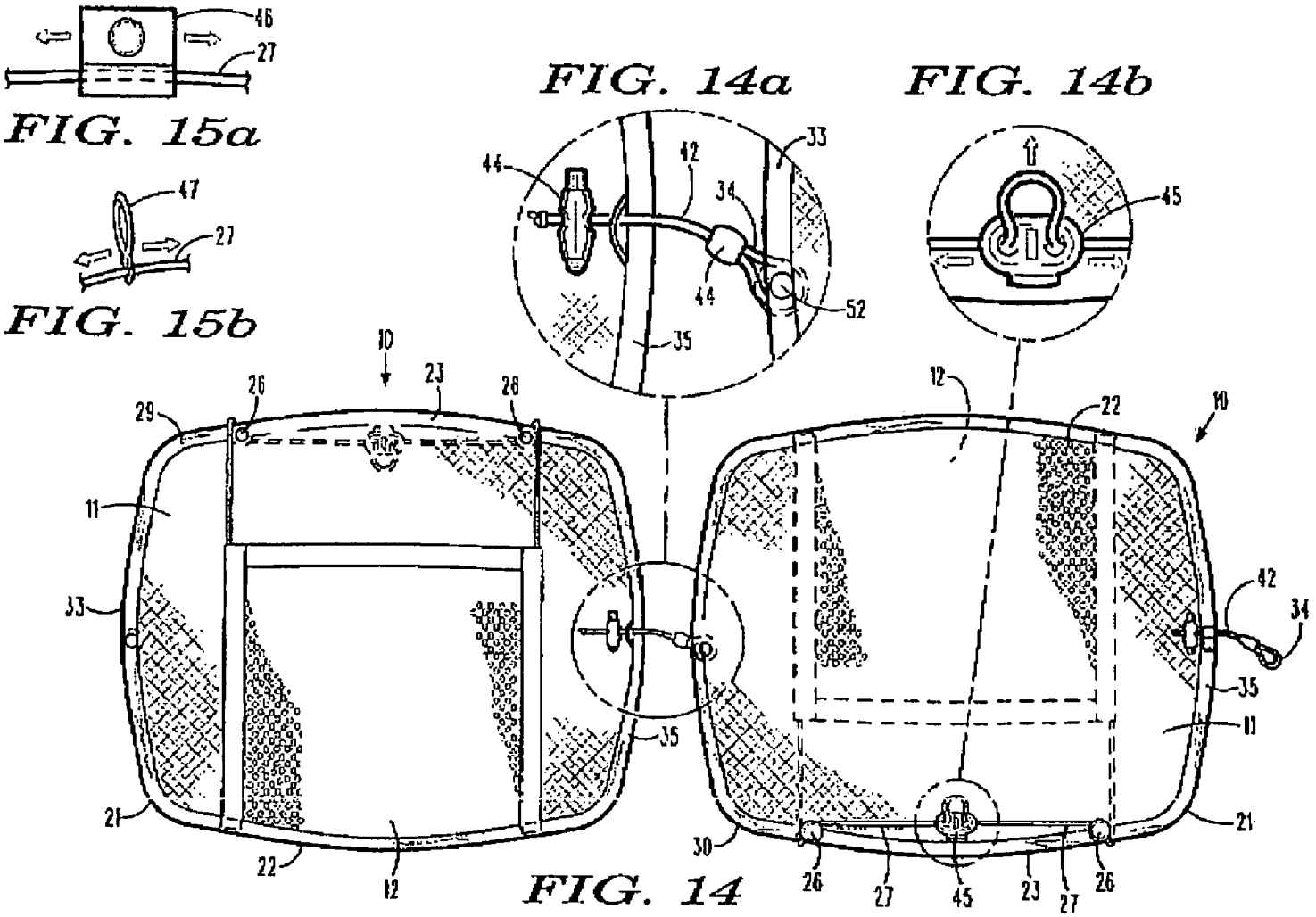
FIG. 14 is a plan view of two third alternative embodiments of the garment restraint assembly according to the present invention showing the top of the left assembly with its restraint panel facing a first direction and the bottom of the right assembly with its restraint panel facing a second direction opposite the first direction.

It is contemplated that the panel linking means may be defined by any number of linking devices or linking mechanisms. In this last regard, several examples of linking type mechanisms have been depicted in the various figures. FIGS. 1, 2, 3, 3(*a*), 4, and 5, for example, show or attempt to depict a first alternative type of panel linking mechanism, namely, cooperative extended snap-type fastener assemblies 31 attached to laterally opposite edges 32 of the support panel(s) 11. FIGS. 13, 14, 14(*a*), and 19 show or attempt to depict a second type of linking mechanism, namely, raised (flange-headed) buttons 52 (akin to buttons 26) attached to a first lateral edge 33 that operate to receive and retain an extended loop 34 attached to a second lateral edge 35 of each support panel 11.

Figure 16:
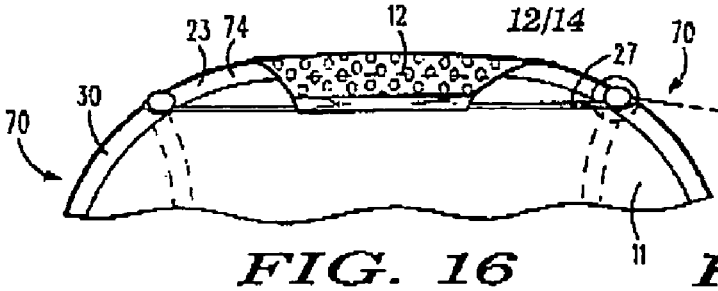
FIG. 16 is a fragmentary view of the back edge of a support panel of a third alternative embodiment of the garment restraint assembly showing an elastic cord and edge of a respective restraint panel being looped over flanged buttons attached to the back side of the support panel.
Figure 16A:
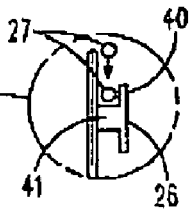
Figure 17:
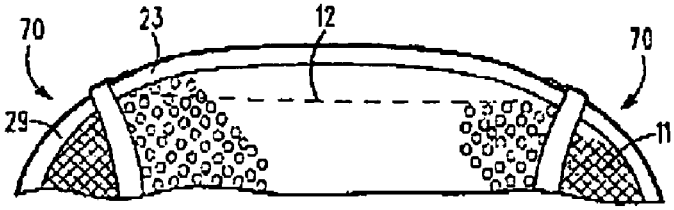
FIG. 17 is a fragmentary view of the front edge of a support panel of a third alternative embodiment of the garment restraint assembly showing a respective restraint panel being folded over the edge of the support panel.
Figure 18:
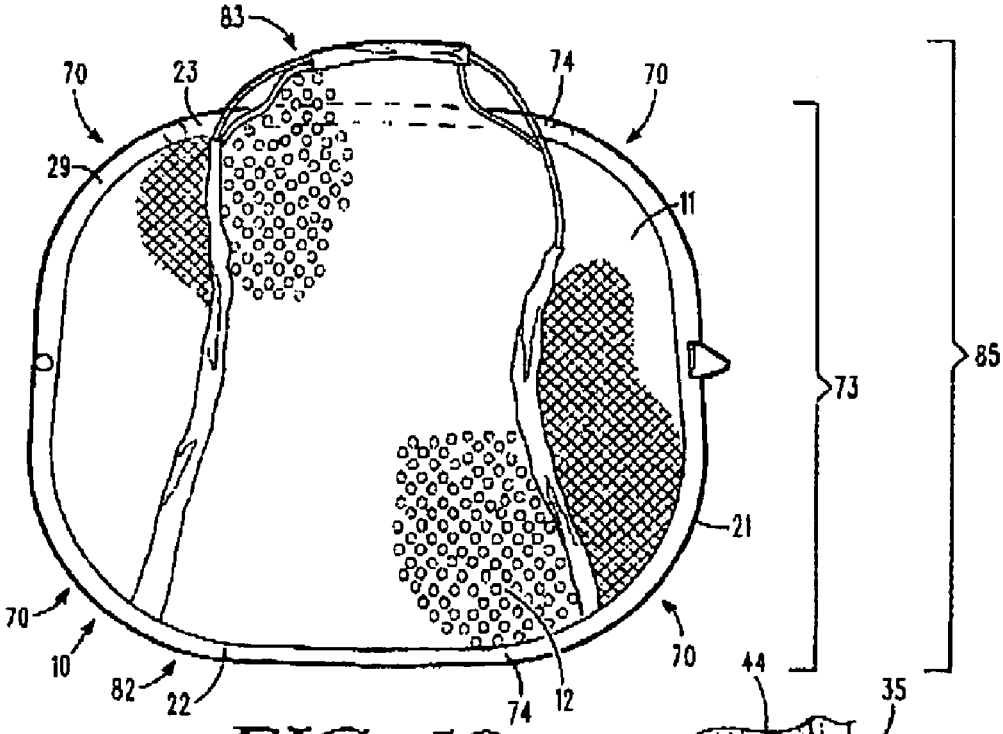
FIG. 18 is a top plan view of a third alternative embodiment of the garment restraint assembly showing a restraint panel having a length greater in magnitude than the width of the underlying support panel.
Figure 19:
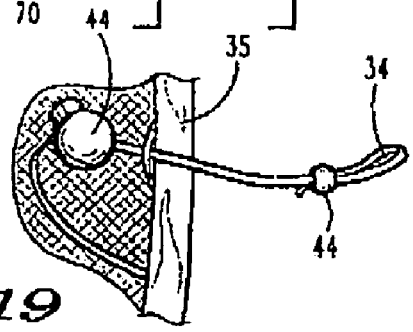
FIG. 19 is an enlarged fragmentary depiction of a cord-type, panel linking mechanism showing cord-pinching devices for (1) adjusting the length of the panel linking mechanism and/or (2) the size of the loop formed at the end of the panel linking mechanism.
Figure 23:
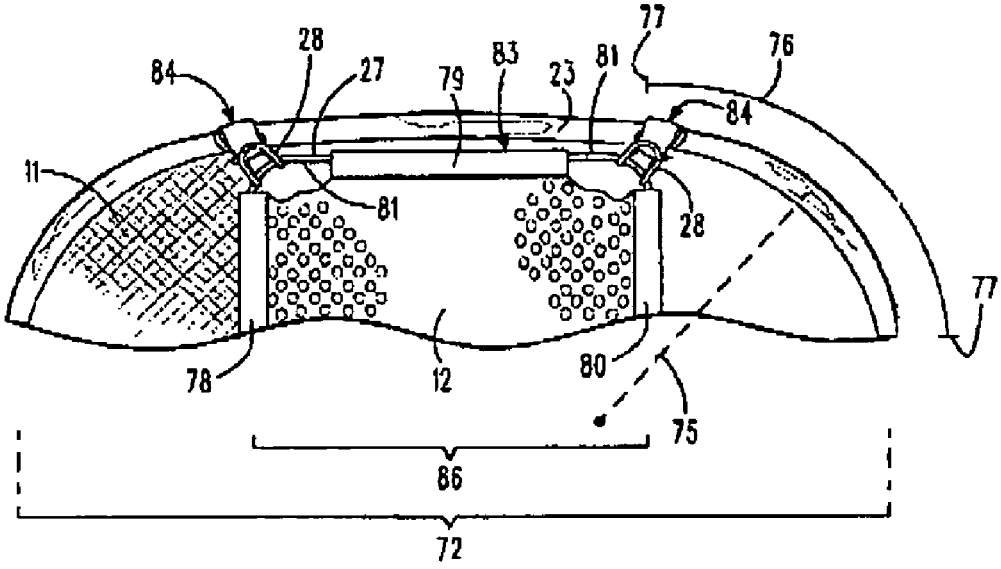
FIG. 23 is an enlarged view of the subject matter otherwise shown in FIG. 20, enlarged to depict in greater clarity the inherent features of the illustrated subject matter.

Notably, from a comparative inspection of FIGS. 13, 14, and 16-18, it may be seen that the buttons 52 may be formed on either a support side 29 of the second edge 23 or a back side 29 of the second edge 23. In this regard, it is noted that bulky or weighty garmentry and the like may require additional restraint holding forces enabled by more fully extending the elastic cord 27 over the edge 23 and loop the same over the buttons 26 as located on the back side 29 of the second edge 23. A flanged head 40 extends from a post 41, which head 40 functions to retain the received cord 27 as generally depicted in FIG. 16(*a*). Less bulky or weighty garmentry and the like may require less stretching of the elastic cord 27 to retain the restrained items upon the support panel(s) 11.

FIGS. 21(*b*) and 21(*c*) show extended female type snap fastener structures 36 attached to a first lateral edge 37 that operate to receive and retain a male snap fastener 38 attached to a second lateral edge 39. FIGS. 22(*a*) and 22(*b*) depict a fifth alternative, preferred means for selectively and removably linking adjacent support panels 11 to one another. In this regard, the reader will note that FIG. 22(*a*) depicts a rigid length of material or pin 61 attached via a length of cord to a second lateral edge 39. The pin 61 may be inserted through grommet 60 attached to a first lateral edge 37 as depicted in FIG. 22(*b*). Notably, the length of pin 61 is greater in magnitude than the inner diameter of grommet 60 so as to provide fastening stop structure after the grommet 60 receives the pin 61.

Other, alternative, less preferable forms may include such arrangements as hook and loop type fasteners such as Velcro brand type hook and loop fastening structure 16 as generally depicted in FIG. 3(*b*). It is contemplated that the panel linking means essentially function to enable the user to interconnect and stack the series of interconnectable garment restraining assemblies 10, which stackable garment restraining assemblies 10 may well allow the user to organize garmentry for travel.

In this last regard, it should be noted that the panel linking means may comprise axes of rotation, one of which is specifically depicted at 100 in FIG. 3(*a*). It will be noted from an inspection of FIG. 3(*a*) that the axes of rotation are preferably and ideally orthogonal to the support panels 11 such that adjacent support panels 11 may thereby be made rotatable about the axes of rotation 100 for enhancing stackability of the garment retaining assemblies 10. Extended fasteners (e.g. fasteners 31, 34, 36, 38) may also be extended from and attached to lateral edging of the panels 11 via flexible and/or elastic material as at 42, which flexible/elastic material 42 allows the user to link the support panels 11 to one another such that the support panels 11 may rotate, fold, or twist at the panel junction site to allow the support panels 11 to be stacked.

For example, it may be seen from a comparative inspection of FIG. 3 versus FIG. 3(*a*) that when outfitted with well known snap fastener type arrangements, the garment restraint assemblies 10 may be rotated about axes of rotation (as at 100) extending through the male and female portions of the arrangement. In other words, the garment restraint assemblies 10 may be rotated about axes of rotation 100 such that the restraint panels 12 are always facing upward while the assemblies 10 are being rotatably placed into stacked, columnar relation as at 50.

In any event, it may thus be said that the panel linking means enable the user to link the support panels 11 into a chain like pattern or "chain link" said support panels 11 such that the restraint panels 12 uniformly face the same upward direction before and after being stacked into columnar relation as at 50. Said assemblies 10 are generally depicted in FIGS. 3, 6, and 7 before being stacked and are shown in FIGS. 9, 10, 11, and 12 after being stacked.

It may be seen from an inspection of FIG. 14 that the panel linking means may enable the user to chain link the support panels 11 such that the restraint panels 12 of adjacent garment restraint assemblies 10 orthogonally face opposite directions relative to the plane of adjacent support panels 11. In FIG. 14, for example, the left most restraint panel faces out of the page and the right most restraint panel faces into the page. This arrangement may be made before opposing panels 11 are stacked. The described panel linking means are foldable so as to enable adjacent support panels 11 to fold into stacked relation within the garment restraint assembly column 50 such that the restraint panels 12 all face the same direction (i.e. all upward (or out of the page)) after being stacked.

From a comparative inspection of FIGS. 9 and 9(*a*), it will be seen that the garment restraint assemblies 10 may be outfitted with certain means for retaining the stacked garment support assemblies in columnar relation as at 50. In other words, the present invention may comprise certain structures and/or methods for retaining the stacked garment support assemblies 10 in columnar relation 50. In this regard, it is contemplated that the top and bottom garment retaining assemblies 10 of the garment restraint assembly column 50 may be removably attached to one another via said panel linking means as at 104 for maintaining the garment retaining assemblies 10 in stacked relation relative to one another when received in luggage 102 (or 103) during travel.

Figure 6:
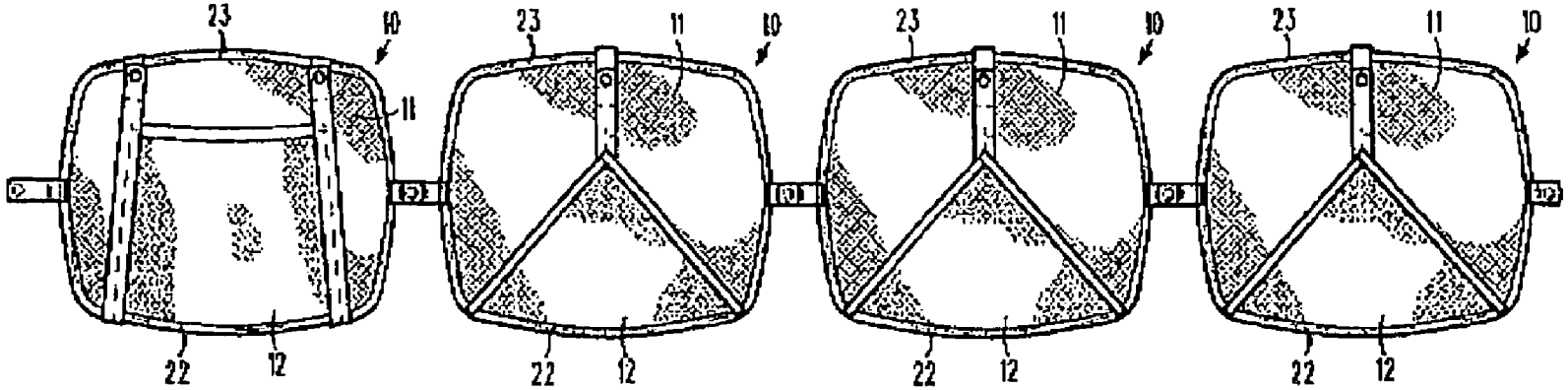
FIG. 6 is a top plan view of a first arrangement of previously depicted and interconnected garment restraint assemblies showing restraint panels facing or pointing in a uniform direction before being stacked.
Figure 7:
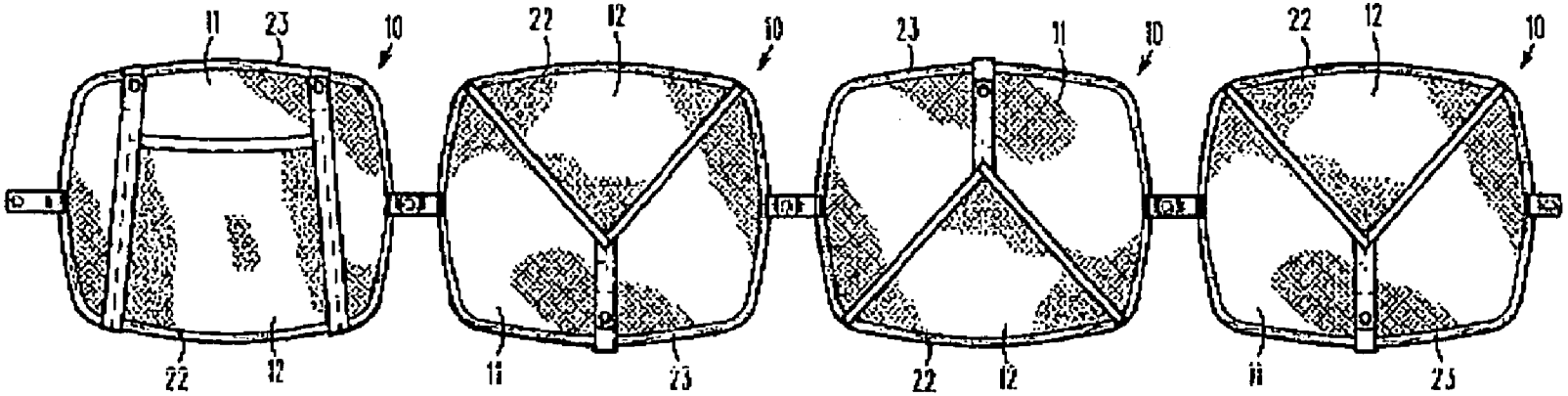
FIG. 7 is a top plan view of a second arrangement of previously depicted and interconnected garment restraint assemblies showing adjacent restraint panels facing opposing directions before being stacked.

Notably, the size and shape of the restraint panels 12 are orientable via said panel linking means so as to either effect a uniform panel pattern (e.g. all panels 12 facing or pointing a uniform direction in the same plane) when in an unstacked orientation as generally depicted in FIG. 6 or the size and shape of the restraint panels 12 are orientable via said panel linking means so as to effect a staggered panel pattern (e.g. adjacent restraint panels 12 facing or pointing opposite directions in the same plane) when in an unstacked orientation as generally depicted in FIG. 7.

Figure 8:
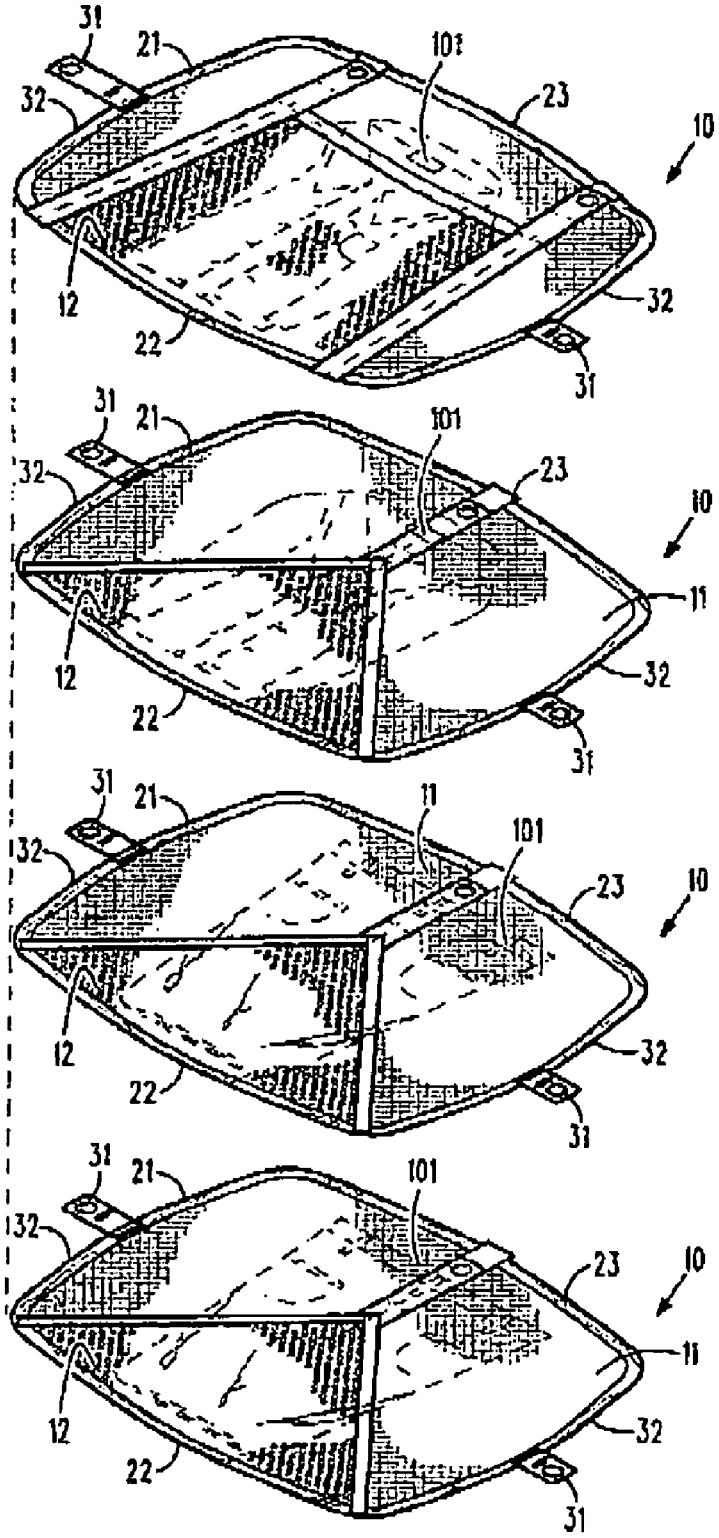
FIG. 8 is a top exploded type perspective view of a series of garment restraint assemblies showing the restraint panels of successfully stacked assemblies facing a uniform direction.

The former uniform panel pattern enables a staggered panel pattern (e.g. the restraint panels 12 of successively stacked assemblies 10 face or point in opposing directions) when in a stacked orientation as generally depicted in FIG. 13; and the latter staggered panel pattern enables a uniform panel pattern (e.g. all restraint panels 12 facing or pointing rightward) when in a stacked orientation as generally depicted in FIG. 8.

The panel linking means may also comprise certain length adjusting means such as cord stops (as at 44) for adjusting the length of the panel linking means and enhancing stackability of the garment restraining assemblies 10. Elastic cord 27 may also be outfitted with certain length adjusting means such as cord stops 45 for altering the effective length of cord 27 for improving the restraint characteristics of the restraint panel(s) 12.

Elastic cord 27 may also be outfitted with certain devices axially displaceable along the length of the cord 27. In this regard, the reader is directed to FIGS. 15(*a*) and 15(*b*), which figures respectively depict a snap fastener assembly 46 and a loop assembly 47 translatable along the length of the cord 27 for enabling the user to effectively move the attachment device(s) 46 or 47 along the cord 27 relative to the buttons 26 in the event of different garmentry bulk loads.

While the above description contains much specificity, this specificity should not be construed as limitations on the scope of the invention, but rather as an exemplification of the invention. For example, it is contemplated that the present invention essentially provides a garment organizing assembly 10 for use with travel, which garment organizing assembly 10 essentially comprises a support panel (as at 11); a restraint panel (as at 12); certain panel attachment means for removably attaching each restraining panel 12 to a respective support panel 11; and certain panel linking means for linking each support panel 11 to an adjacent support panel 11 as heretofore exemplified.

The support panel 11 supports garmentry 101 (or similar other travel items) placed thereupon. The restraint panel 12 is fixedly attached to a first edge of a respective support panel 11. The panel attachment means removably attach the restraint panel 12 to a second edge of the support panel 11, and thus the restraint panel 12 essentially functions to selectively restrain garmentry 101 otherwise supported by the support panel 11. The panel linking means enable the user to interconnect (and stack) a series of garment restraint assemblies 10 for organizing garmentry 101 for travel.

The support and restraint panels 11 and 12 are each preferably constructed from flexible material, but the support panel 11 may preferably further comprise certain means for maintaining a substantially planar support panel periphery such as pre-shaped, heavy gauge wire 18 about which the flexible material of the support panel 11 may be formed. Notably, the support panel 11 is preferably sized and shaped for cooperable use with standardized luggage.

The restraint panel 12 preferably comprises a restraint panel periphery lesser in magnitude than the support panel periphery as generally depicted throughout the drawings. The panel linking means may preferably be made cooperable with flexible and/or elastic material (as at 42) for enhancing the stackability of a plurality of interconnected garment restraint assemblies 10.

It is contemplated that the preferred embodiment according to the present invention essentially provides a garment organizing assembly for use with travel, which garment organizing assembly comprises a support panel assembly (as at 11), a restraint panel assembly (as at 12), and certain panel attachment means as heretofore exemplified.

The support panel assembly 11 comprises certain peripheral support means and centralized flexible support material for supporting garmentry placed thereupon. The peripheral support means comprise a frame-providing structural member (as at 18) for maintaining a substantially planar, rectangular support panel periphery with four first panel rounded corners (as at 70), and a support-sheathing structure 71 for covering and concealing the frame-providing structural member 18.

The substantially planar support panel periphery comprises a support panel length as at 72 and a support panel width as at 73. The support panel assembly thus comprises first and second opposed side edges as at 74, and first and second opposed end edges as at 32. The first panel rounded corners 70 each comprise a first radius of curvature as at 75 for defining an arc length 76 having arc length termini as at 77.

The restraint panel assembly 12 comprises (1) an outer elastic periphery-defining element as at cord 27; (2) first, second and third element-sheathing structures as at 78, 79, and 80 respectively for covering and concealing portions of the outer elastic periphery-defining element or cord 27; and (3) centralized flexible restraint material as at netting 20 for restraining garmentry supported by the centralized flexible support material. The first, second and third element-sheathing structures 78, 79, and 80 respectively cover and conceal portions of the outer elastic periphery-defining element or cord 27, thereby exposing first and second hook-engaging portions 81 of the element or cord 27.

The panel attachment means essentially function to (1) removably attach a first end 82 of the restraint panel assembly 12 to the first side edge 74 of the support panel assembly 11; and (2) permanently attach a second end 83 of the restraint panel assembly 12 to the second side edge 74 of the support panel assembly 11. The panel attachment means (for removably attaching the first end 82 of the restraint panel assembly 12 to the first side edge 74) are preferably defined by first and second hook assemblies as at 84 permanently attached to the first side edge 74 adjacent the rounded corners 70 at the arc length termini 77, and extend inwardly from the support panel periphery at roughly 45 degrees relative to the first side edge 74.

The outer elastic periphery-defining element or cord 27 is elastically actuatable such that the first and second hook-engaging portions 81 engage the first and second hook assemblies 84. The outer elastic periphery-defining element or cord 27 thereby defines a substantially rectangular restraint panel extending centrally and widthwise across the support panel assembly 11. The rectangular support panel comprises a restraint panel length as at 85, and a restraint panel width as at 86. The restraint panel length 85 is preferably lesser in magnitude than the support panel width 73.

The foregoing specifications are further believed to support certain methodology for organizing garmentry for travel, which garmentry organizing method may be said to essentially comprise a series of steps. In this regard, it is contemplated that one or more garment restraint assemblies are initially provided, wherein each garment restraint assembly 10 comprises a support panel 11, a restraint panel 12, certain panel attachment means for removably attaching each restraint panel 12 to a respective support panel 11, and certain panel linking means for linking each support panel 11 to an adjacent support panel 11.

When so provided, garmentry 101 may then be supported upon select support panels 11 and restrained upon the select support panels 11 via select restraint panels 12 respectively attached to the select support panels 11 via said panel attachment means. The series of garment restraint assemblies 10 may then be linked to one another via the panel linking means, and stacked into a garment restraint assembly column as at 50 for further travel, such as by inserting the column 50 into column-receiving luggage as at 102 or 103.

Accordingly, although the invention has been described by reference to certain preferred and alternative embodiments, and certain methodology, it is not intended that the novel disclosures herein presented be limited thereby, but that modifications thereof are intended to be included as falling within the broad scope and spirit of the foregoing disclosure, the following claims and the appended drawings.

I claim:

1. A garment organizing assembly for use with travel, the garment organizing assembly comprising:

a support panel assembly, the support panel assembly comprising peripheral support means and centralized flexible support material, the peripheral support means comprising a frame-providing structural member for maintaining a substantially planar, rectangular support panel periphery with four first panel rounded corners, and a support-sheathing structure for covering and concealing the frame-providing structural member the substantially planar support panel periphery comprising a support panel length and a support panel width, the support panel assembly thus comprising first and second opposed side edges and first and second opposed end edges, the first panel rounded corners each comprising a first radius of curvature and an arc length, the arc lengths each comprising arc length termini, the centralized flexible support material for supporting garmentry placed thereupon;

a restraint panel assembly, the restraint panel assembly comprising an outer elastic periphery-defining element, first, second and third element-sheathing structures for respectively covering and concealing portions of the outer elastic periphery-defining element, and centralized flexible restraint material, the first, second and third element-sheathing structures respectively covering and concealing portions of the outer elastic periphery-defining element, thereby exposing first and second hook-engaging portions, the centralized flexible restraint material for restraining garmentry supported by the centralized flexible support material; and panel attachment means for removably attaching a first end of the restraint panel assembly to the first side edge, and for permanently attaching a second end of the restraint panel assembly to the second side edge, the panel attachment means for removably attaching the first end of the restraint panel assembly to the first side edge being defined by first and second hook assemblies permanently attached to the first side edge adjacent the rounded corners at the arc opposed arc length termini and extending inwardly from the support panel periphery, the outer elastic periphery-defining element being elastically actuatable such that the first and second hook-engaging portions engage the first and second hook assemblies, the outer elastic periphery-defining element thereby defining a substantially rectangular restraint panel extending centrally and widthwise across the support panel assembly, the rectangular restraint panel comprising a restraint panel length and a restraint panel width, the restraint panel length being lesser in magnitude than the support panel width.

2. The garment organizing assembly of claim 1 wherein said hook assemblies comprise saddle shaped hook elements, the saddle shaped hook elements for enhancing receipt of the first and second hook-engaging portions.

3. A garmentry organizing method for organizing garmentry with travel, the garmentry organizing method comprising the steps of:

providing at least one garment restraint assembly, each garment restraint assembly comprising:

a support panel assembly, the support panel assembly comprising peripheral support means and centralized flexible support material, the peripheral support means comprising a frame-providing structural member for maintaining a substantially planar, rectangular support panel periphery with four first panel, rounded corners, and a support-sheathing structure for covering and concealing the frame-providing structural member, substantially planar support panel periphery comprising a support panel length and a support panel width, the support assembly thus comprising first and second opposed side edges and first and second opposed end edges, the first panel, rounded corners each comprising a first radius of curvature and an arc length, the arc lengths each comprising arc length termini, the centralized flexible support material for supporting garmentry placed thereupon;

a restraint panel assembly, the restraint panel assembly comprising an outer fining element, first, second and third element-sheathing structures for respectively covering and concealing portions of the outer elastic periphery-defining element, and centralized flexible restraint material, the first, second and third element-sheathing structures respectively covering and concealing portions of the outer elastic periphery-defining element, thereby exposing first and second hook-engaging portions, the centralized flexible restraint material for restraining garmentry supported by the centralized flexible support material; and panel attachment means for removably attaching a first end of the restraint panel to the first side edge, and for permanently attaching a second end of the restraint panel to the second side edge, the panel attachment means for removably attaching the first end of the restraint panel to the first side edge being defined by first and second hook assemblies permanently attached to the first side edge adjacent the rounded corners at the arc opposed arc length termini and extending inwardly from the support panel periphery, the outer elastic periphery-defining element being elastically actuatable such that the first and second hook-engaging portions engage the first and second hook assemblies, the outer elastic periphery-defining element thereby defining a rectangular restraint panel extending centrally and widthwise across the support panel assembly, the rectangular support panel comprising a restraint panel length and a restraint panel width, the restraint panel length being lesser in magnitude than the support panel width;

supporting garmentry upon a select support panel assembly; and restraining garmentry upon the select support panel assembly via a select restraint panel assembly respectively and removably attached to the select support panel assembly via the panel attachment means.

4. The method of claim 3 wherein said hook assemblies comprise saddle-shaped hook elements, the hook elements of the panel attachment means being cooperable with the first and second hook-engaging portions for enhancing releasable garment restraint.

* * * * *